US008505163B2

(12) United States Patent
Lin

(10) Patent No.: US 8,505,163 B2
(45) Date of Patent: Aug. 13, 2013

(54) HOOK DEVICE FOR STRETCHING CURTAIN ON RACK ASSEMBLY

(76) Inventor: Ruei-Hsing Lin, Taipei Hsien (TW)

( * ) Notice: Subject to any disclaimer, the term of this patent is extended or adjusted under 35 U.S.C. 154(b) by 274 days.

(21) Appl. No.: 12/963,644

(22) Filed: Dec. 9, 2010

(65) Prior Publication Data

US 2012/0144625 A1 Jun. 14, 2012

(51) Int. Cl.
*E05D 15/06* (2006.01)

(52) U.S. Cl.
USPC ..... 16/87.8

(58) Field of Classification Search
USPC ..... 16/87 R–107; 52/71; 160/118, 345
See application file for complete search history.

(56) References Cited

U.S. PATENT DOCUMENTS 1,604,937 A * 10/1926 Edsall ..... 16/87.8
2,901,795 A * 9/1959 Graber ..... 24/345
3,441,077 A * 4/1969 Romano ..... 160/348
5,975,187 A * 11/1999 Chou ..... 160/345
6,467,127 B1 * 10/2002 Goldstein ..... 16/87 R
6,598,355 B2 * 7/2003 Owens ..... 52/71
7,392,747 B2 * 7/2008 Ksyk ..... 104/96
7,788,769 B2 * 9/2010 Wicker et al. ..... 16/87 R
8,256,062 B2 * 9/2012 Banks et al. ..... 16/87 R

* cited by examiner

*Primary Examiner* — Victor Batson
*Assistant Examiner* — Matthew Sullivan

(57) ABSTRACT

The hook device contains a base, at least a first wheel, a second wheel, a third wheel, and at least an elastic hook element. The base has a first wall and, extending respectively from two lateral edges of the first wall, a second wall and a third wall. The wheels are positioned on the walls, respectively. Along the edge between the first and second walls, an extension piece with a curved outer edge is extended for the configuration of the elastic hook element. The wheels are embedded in a first, second, and third grooves of a column, respectively. The base's three wheels, together with the corresponding configurations of separate grooves, enable the base to be reliably mounted on and moved along the column. The elastic hook element, with its elastic and buffering mechanism, provides multi-stage buffering and thereby is capable of withstanding a significant degree of wind impact.

6 Claims, 5 Drawing Sheets

HOOK DEVICE FOR STRETCHING CURTAIN ON RACK ASSEMBLY

(a) TECHNICAL FIELD OF THE INVENTION

The present invention is generally related to racks for expanding and displaying a curtain, and more particularly to a hook device on the rack assembly having superior robustness to wind impact.

(b) DESCRIPTION OF THE PRIOR ART

Advertisement has become a form of communication and, as technology advances, the form of advertisement has taken up many different styles, tangible and intangible.

Despite that, physical means such as billboards and curtains are still widely popular and people encounter these advertisement means constantly at road intersections or exhibition halls. Conventionally, an advertisement curtain is stretched and displayed on a rack assembly as shown in FIG. 1. As illustrated, the rack assembly contains a number of columns A, each having a single groove A1 for the configuration of a number of hook elements B capable of vertical up/down movement along the groove A1. A curtain C has a number of strings C1 along its edges, each pulled by a number of hook elements B so that the curtain C could be raised and expanded by lifting the hook elements B. The hook elements B also help expanding and stretching the curtain C so that it is flatly displayed.

The hook elements B used on the conventional rack do not have any elastic and buffering mechanism and, therefore, when the curtain C is under the impact of winds from various directions, the strings C1 often break down if they cannot withstand the force exerted on them. The subsequent repair and replacement cost and effort could be significant, thereby affecting the applicability of the rack assembly.

Additionally, the strings C1 are constantly under the influence of force. Together with the outdoor temperature variation and the exposure to sun and rain, the strings C1 would deteriorate and collapse after a period of usage. If one of the strings C1 breaks down, the other strings C1 would have to bear more loads, speeding up their breaking down.

Further more, as the hook elements B are configured in a single groove A1, the impact of winds on the curtain C is transferred to the hook elements B through the strings C1. The hook elements B therefore would shake within the groove A1, producing annoying clanking noise or even causing the groove A1 to deform.

SUMMARY OF THE INVENTION

Therefore, a novel hook device is provided herein so as to obviate the shortcomings of the prior art by incorporating an elastic and buffering mechanism for withstanding a significant degree of wind impact.

The hook device contains a base, at least a first wheel, a second wheel, a third wheel, and at least an elastic hook element. The base has a first wall and, extending respectively from two lateral edges of the first wall, a second wall and a third wall. The wheels are positioned on the walls, respectively. Along the edge between the first and second walls, an extension piece with a curved outer edge is extended for the configuration of the elastic hook element. The wheels are embedded in a first, second, and third grooves of a column, respectively. The base's three wheels, together with the corresponding configurations of separate grooves, enable the base to be reliably mounted on and moved along the column.

The elastic hook element, with its elastic and buffering mechanism, provides multi-stage buffering and thereby is capable of withstanding a significant degree of wind impact.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
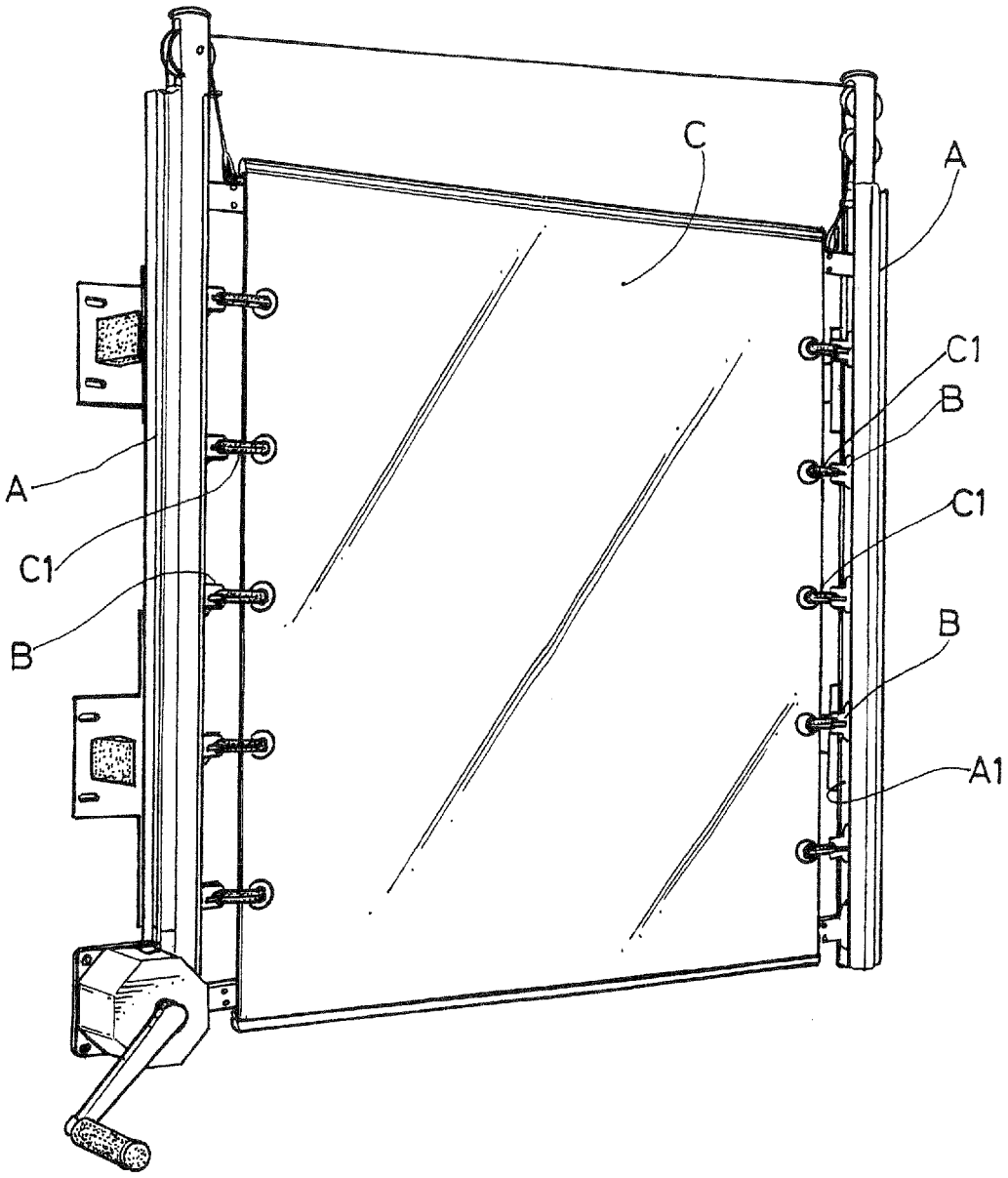
FIG.1 PRIOR ART
FIG. 1 is a perspective diagram showing a conventional rack assembly.
Figure 2:
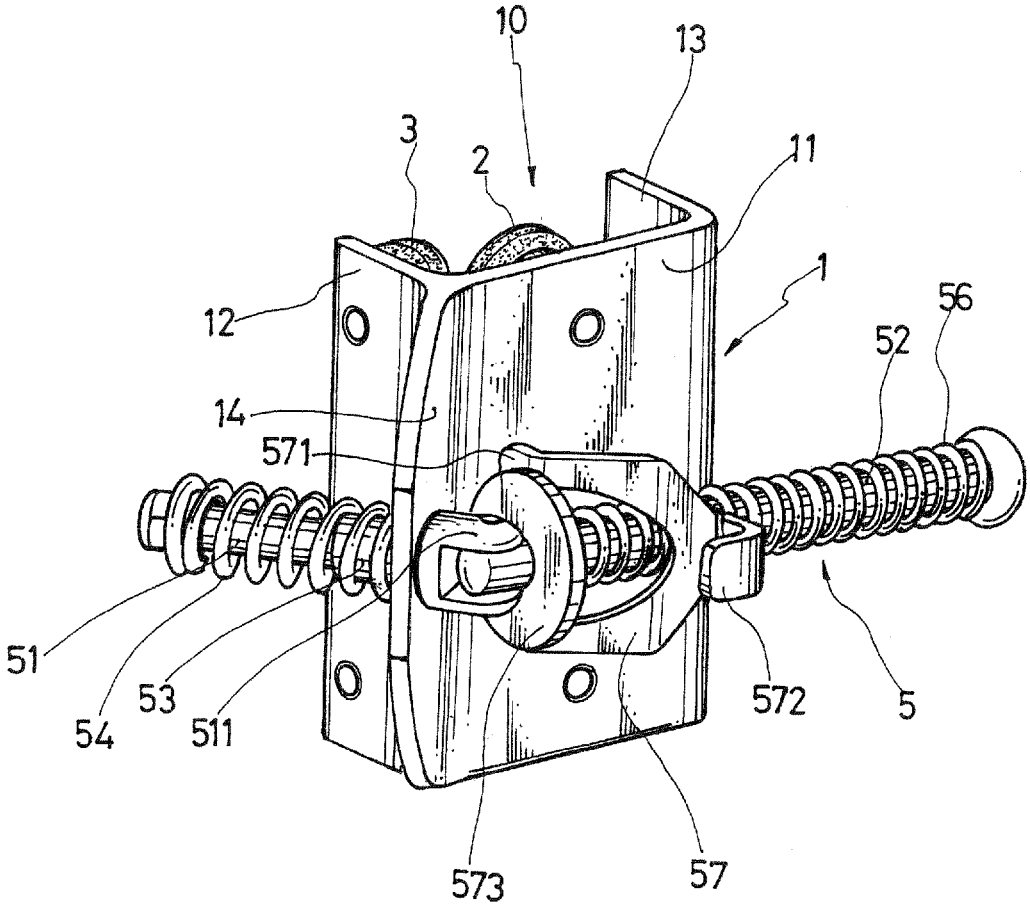
FIG. 2 is a perspective diagram showing a hook device according to an embodiment of the present invention.
Figure 3:
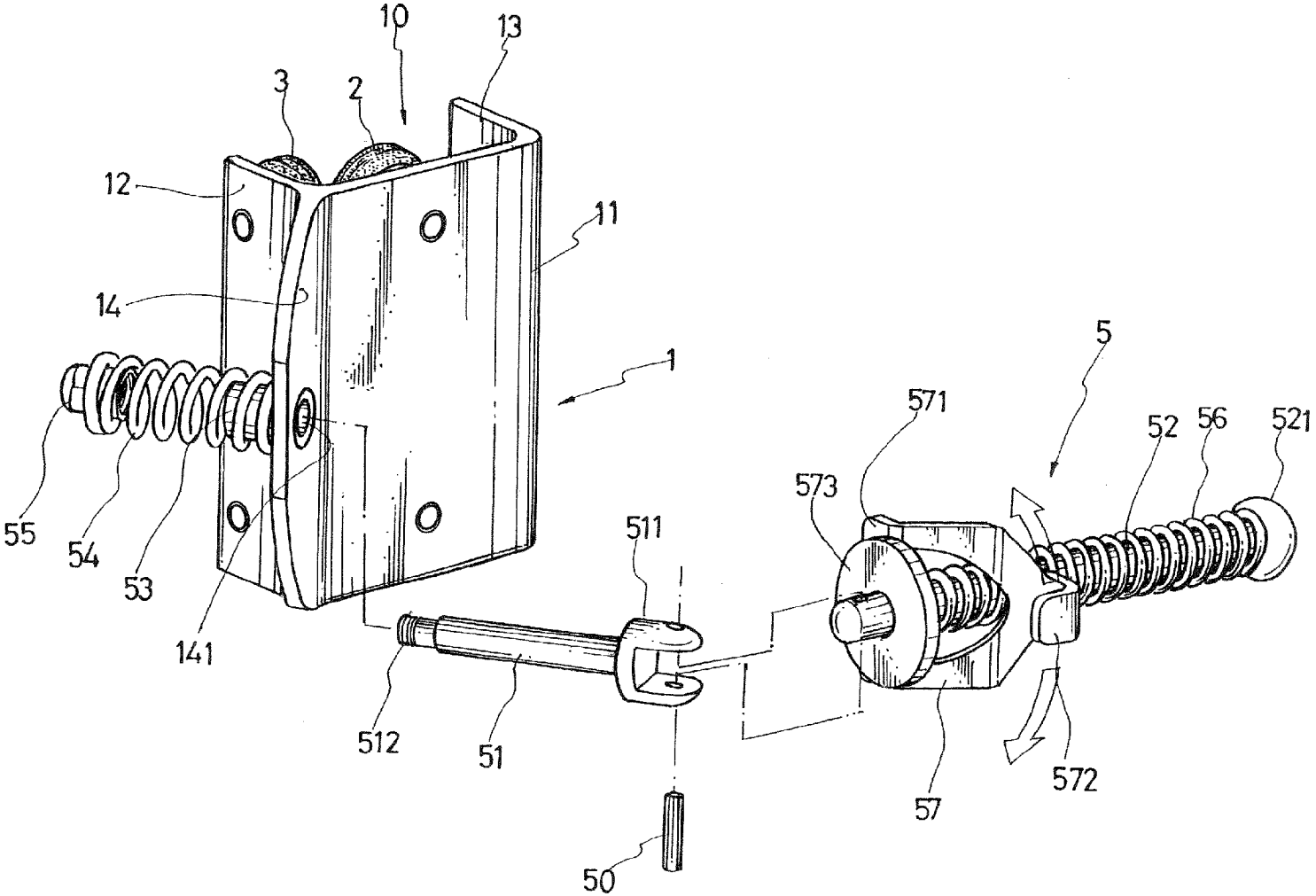
FIG. 3 is a perspective break-down diagram showing various components of the hook device of FIG. 2.
Figure 4:
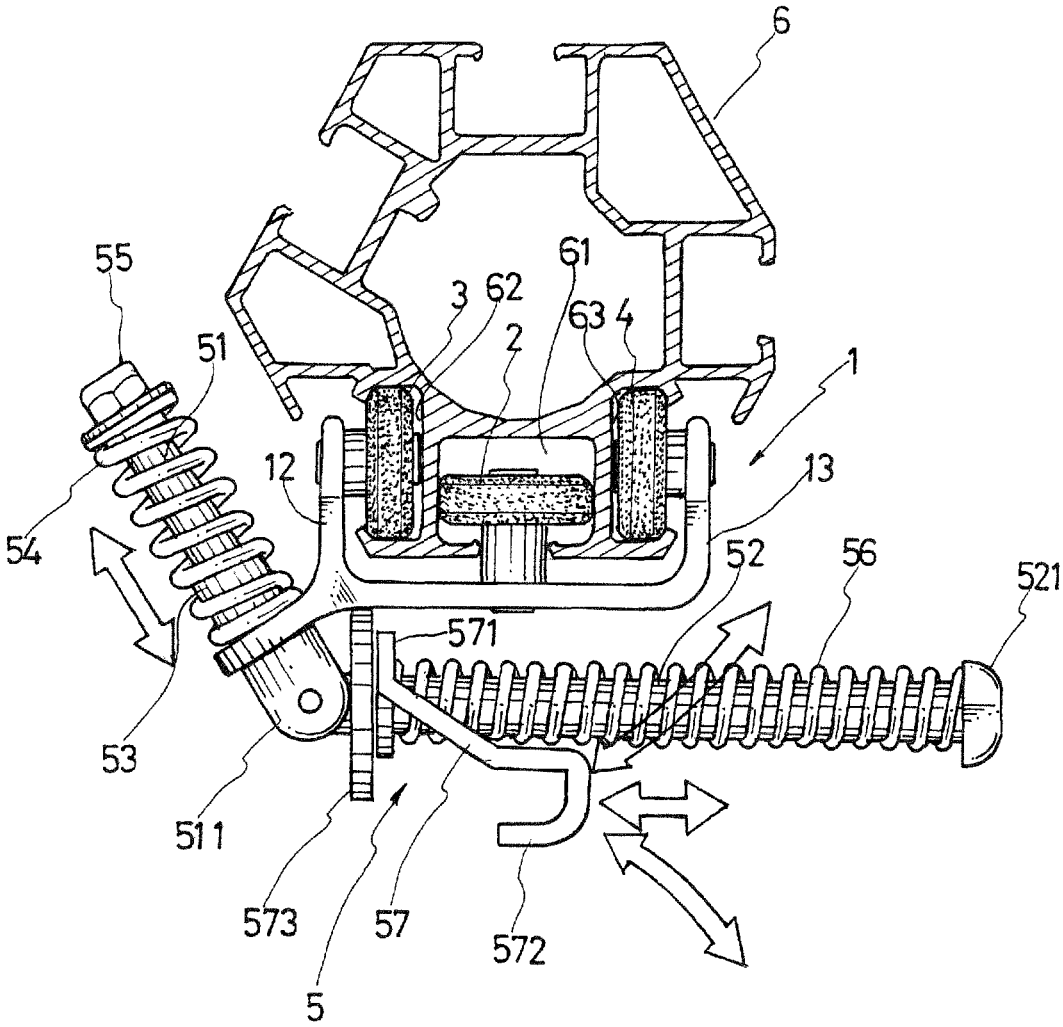
FIG. 4 is a top-view diagram showing the hook device of FIG. 1 joined to a column.
Figure 5:
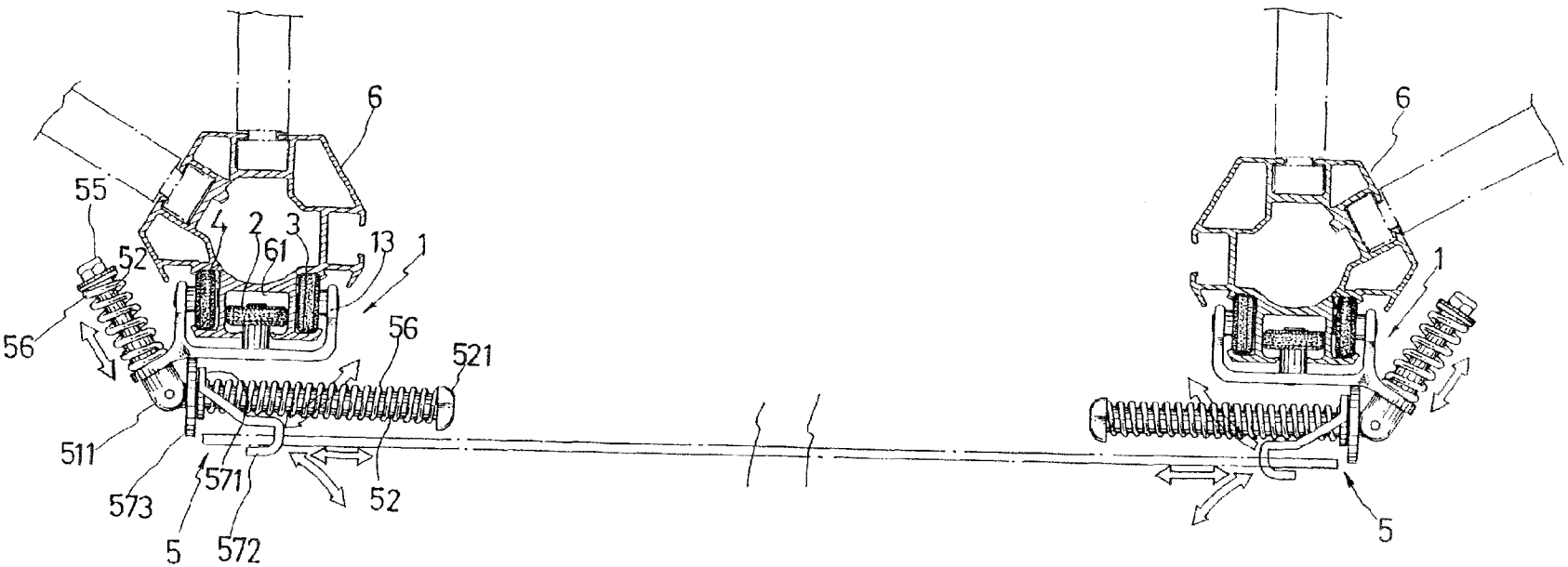
FIG. 5 is a top-view diagram showing an application scenario of the hook device of FIG. 1 on a rack assembly.

As shown in FIGS. 2 to 5, a hook device according to an embodiment of the present invention is for application on a column 6 having at least a first groove 61, at least a second groove 62, and at least a third groove 63. The hook device contains a base 1, at least a first wheel 2, at least a second wheel 3, at least a third wheel 4, and at least an elastic hook element 5. The base 1 has a first wall 11 and, extending respectively from two lateral edges of the first wall 11, a second wall 12 and a third wall 13. The first, second, and third walls 11, 12, 13 jointly form a C-like shape around a space 10. The first, second, and third grooves 61, 62, 63 are threaded through the space 10 and surrounded by the C-like shape. Along the edge between the first and second walls 11 and 12, an extension piece 14 with a curved outer edge is extended. The extension piece 14 has at least a through hole 141.

The first, second, and third wheels 2, 3, 4 are housed in the space 10, and positioned on the first, second, and third walls 11, 12, and 13, respectively. They are then embedded into the first, second, and third groove 61, 62, and 63, respectively.

The elastic hook element 5 is configured through the through hole 141 of the extension piece 14. The elastic hook element 5 contains a first shaft 51, a second shaft 52, a tubular sleeve 53, a first spring 54, a nut 55, a second spring 56, and a hook piece 57. The first shaft 51 has a pivot section 511 at one end and a fastening section 512 at the other end. The first shaft 51 is threaded through the through hole 141, the tubular sleeve 53, and then the first spring 54. The nut 54 is then screwed to the fastening section 512 of the first shaft 51, so that the first shaft 51 is confined between the first shaft 51 and the extension piece 14, and that the first shaft 51 could move elastically through the through hole 141. The second shaft 52 has a stop section 521 at one end, and the other end is pivotally joined to the pivot section 511 by a pin 50, after threading through the second spring 56 and the hook piece 57. The second spring 56 and the hook piece 57 are therefore fixedly joined to the second shaft 52. The hook piece 57 contains a base section 571 and a hook section 572. The base section 571 has a through hole allowing the second shaft 52 to thread through. As such, the base section 571 could on one hand axially move along the second shaft 52 and, on the other hand, press against the second spring 56. A disc piece 573 is configured in front of the base section 571 and the base section 571 is substantially covered by the disc piece 573. The disc piece 573 provides a point of support when the second shaft 52 is forced backward by winds and the first shaft 51 is exerted as well in the mean time. In words, the first and second shafts 51 and 52 are joined to sustain the impact of winds. The disc piece 573 also prevents the base section 571 from rubbing against the first wall 11 and causing obstruction. The hook section 572 is for connection to a curtain or hooking a string of the curtain.

As such, when the base 1 is assembled to a column 6, the first, second, and third grooves 61, 62, 63 pass through the space 10 and surrounded by the C-like shape of the base 1, and the first, second, and third wheels 2, 3, 4 are embedded in the first, second, and third grooves 61, 62, 63, respectively. With the embedding of the three wheels, the base 1 could be reliably held by and moved along the column 6.

The hook element 5's hook piece 57 could grasp a string of a curtain and, when wind is blown directly against the curtain's front, the hook piece 57 is pulled laterally and inward by the string. The second spring 56 is compressed, thereby providing a first stage of buffering. As the wind further engages the hook piece 57, with the point of support provided by the disc piece 573, the first shaft 51 is pulled and the first spring 54 is compressed as well, thereby providing a second stage of buffering. Similarly, when the curtain's back is blown against by wind, the hook piece 57 is pulled laterally and outward by the string. Again, the second spring 56 is compressed, thereby providing a first stage of buffering. As the wind further engages the hook piece 57, with the point of support provided by the disc piece 573, the first shaft 51 is pushed and the first spring 54 is stretched, thereby providing a second stage of buffering. As described, the present invention is therefore able to sustain a high degree of wind impact, and the curtain and its strings are prevented from breaking from strong winds.

Please note that the first, second, and third wheels 2, 3, 4 could be oriented differently in accordance with the first, second, and third grooves 61, 62, 63. For example, in an alternative embodiment, the first wheel 2 is axially oriented toward an X axis while the second and third wheels 3, 4 are axially oriented toward a Y axis. As such, the first wheel 2 could provide lateral positioning within the first groove 61 while the second and third wheels 3, 4 could provide front-and-back positioning. The base 1 is therefore curbed from three points by the first, second, and third wheels 2, 3, and 4, respectively. The base 1 is as such reliably mounted on and moved along the column 6.

The gist of the present invention is therefore as follows. Each elastic hook element, with its two springs jointly working together, provides two stages of buffering and thereby is capable of withstanding a significant degree of wind impact. The base's three wheels of different orientations, together with the corresponding configurations of separate grooves, enables the base to be reliably mounted on and moved along the column.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hook device installed on a column having at least a first groove, a second groove, and a third groove for connecting and stretching a curtain, comprising:

a base having a first wall and, extending respectively from two lateral edges of said first wall, a second wall and a third wall, and an extension piece extending outward along the edge between said first and second walls; said first, second, and third walls jointly forming a space threaded by said first, second, and third grooves of said column; said extension piece having at least a through hole;

at least a first wheel, a second wheel, and a third wheel configured in said space to said first, second, and third walls, respectively; said first, second, and third wheels slidably embedded in said first, second, and third grooves of said column, respectively; and at least an elastic hook element connecting said curtain; said elastic hook element configured on said through hole of said extension piece;

wherein said elastic hook element contains a first shaft, a second shaft, a tubular sleeve, a first spring, a nut, a second spring, and a hook piece; said first shaft has a first end threaded through said through hole of said extension piece, said tubular sleeve, and said first spring; said first end of said first shaft is then fastened by said nut; said first shaft has a second end pin-joined to a first end of said second shaft; and said second shaft has a second end threaded through said hook piece and said second spring.

2. The hook device according to claim 1, wherein said extension piece has a curved outer edge.

3. The hook device according to claim 1, wherein said first shaft has a fastening section at said first end for fastening said nut and a pivot section at said second end for pin-joining said second shaft.

4. The hook device according to claim 1, wherein said second shaft has a stop section at said second end.

5. The hook device according to claim 1, wherein said hook piece contains a base section and a hook section; said base section has a through hole allowing said second shaft to thread through; and said hook section is connected to said base section.

6. The hook device according to claim 5, wherein a disc piece is configured in front of said base section; and said base section is substantially covered by said disc piece.

* * * * *